US005150092A

United States Patent [19]

Kolb

[11] Patent Number: 5,150,092

[45] Date of Patent: Sep. 22, 1992

[54] CONTROL BUTTON ADAPTOR FOR ELECTRIC CONTROL APPARATUS

[75] Inventor: Arthur F. Kolb, Bowling Green, Ky.

[73] Assignee: Eaton Corporation, Cleveland, Ohio

[21] Appl. No.: 665,873

[22] Filed: Mar. 6, 1991

[51] Int. Cl.[5] ..... H01H 67/02

[52] U.S. Cl. ..... 335/132; 200/332.2

[58] Field of Search ..... 335/131-132, 335/202; 200/305, 331, 332, 332.1, 332.2

[56] References Cited

U.S. PATENT DOCUMENTS

| | | | |
|---|---|---|---|
| 2,673,268 | 3/1954 | Kuhn et al. . | |
| 3,200,657 | 8/1965 | Barden et al. . | |
| 3,336,458 | 8/1967 | Hadley | 200/332 |
| 3,457,377 | 7/1969 | Olson . | |
| 3,681,553 | 8/1972 | Lehman et al. . | |
| 4,056,115 | 11/1977 | Thomas . | |
| 4,096,465 | 6/1978 | Fryer . | |
| 4,194,104 | 3/1980 | Stenta . | |
| 4,209,820 | 6/1980 | Rundel et al. . | |
| 4,362,916 | 12/1982 | Anderson | 200/332 |
| 4,499,352 | 2/1985 | Fujita et al. . | |
| 4,525,694 | 6/1985 | Dennison et al. . | |

FOREIGN PATENT DOCUMENTS

| | | | |
|---|---|---|---|
| 617020 | 1/1949 | United Kingdom | 200/331 |

*Primary Examiner*—Lincoln Donovan
*Attorney, Agent, or Firm*—L. G. Vande Zande

[57] ABSTRACT

A one-piece molded adaptor comprises a rectangular frame having inwardly directed ledges on opposed lateral legs cooperably engagable with projections on a contactor housing normally intended to interlock with an auxiliary contact block housing. The frame fits firmly over a rectangular protrusion of the contractor housing to securely lock the adaptor to the contactor. A depending cantilever portion provides a laterally offset portion overlying a reset plunger of an overload relay and provides a finger-engagable pushbutton portion offset from the plunger and centrally located relative to the starter panel footprint to mimic the reset button location of earlier generation starters.

12 Claims, 2 Drawing Sheets

FIG 4
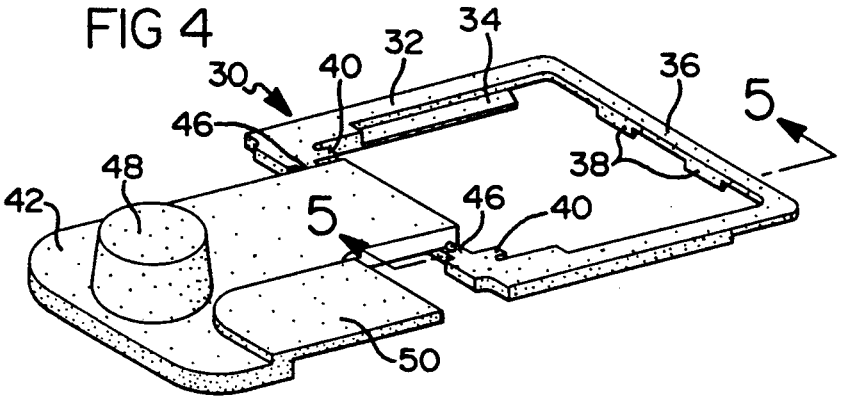
FIG 5
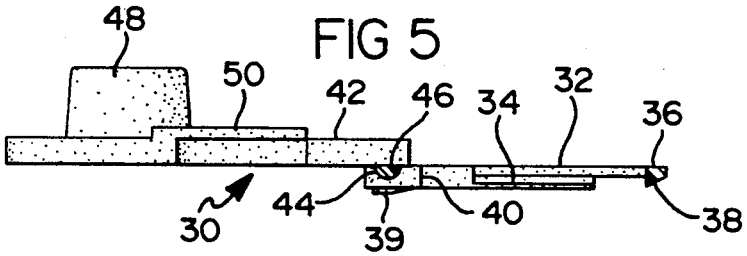
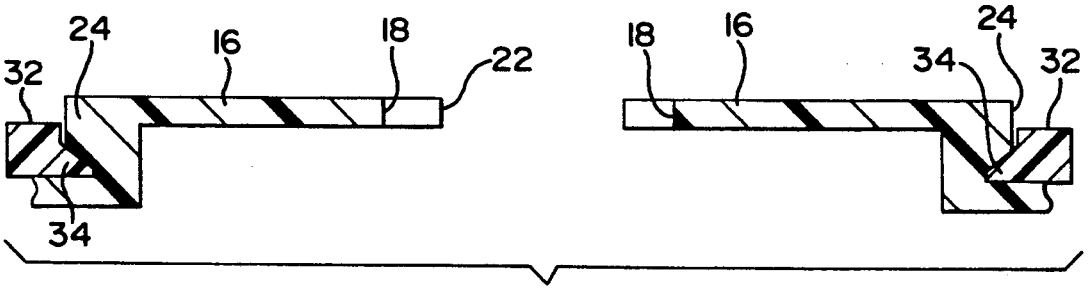
FIG 6

CONTROL BUTTON ADAPTOR FOR ELECTRIC CONTROL APPARATUS

BACKGROUND OF THE INVENTION

This invention relates to electric control apparatus and in particular to electric motor starters. Still more particularly this invention relates to a control button adaptor which is attachable to the starter to overlie a reset plunger and provide a finger-engagable button portion laterally offset from the reset plunger.

Electric motor starters comprise a power rated switching device and overload protection, commonly an electromagnetically operated contactor and an overload relay, usually mounted on a common mounting plate and electrically interconnected wherein individual poles of each device are connected in series. Through such apparatus, a motor is connected and disconnected from an electric supply by energization or deenergization of the contactor operating coil through a control element such as a manual switch, sensor or another relay. The overload relay of the starter monitors current flow through the apparatus to the motor to deenergize the contactor coil and disconnect the motor in the event of abnormal potentially harmful current flow to the motor.

Overload relays may selectively be made automatically or manually resettable. A depressible plunger or leveler, hereinafter referred to singularly as "plunger", is commonly provided in an overload relay for manually resetting the mechanism. Overload relay designs of thirty to forty years ago incorporated a finger-sized button directly on the end of the reset plunger, such button extending through, or being accessible through, a hole in an enclosure for the starter or in cabinetry of the apparatus in which the starter is used. In such designs the reset plunger was located at or near a midpoint between lateral edges of the relay. In more recent designs, the reset plunger is located at one side of the overload relay. As various models of starters are superseded by newer designs, the change in position of the reset plunger relative to the configuration of the starter presents a problem for original equipment manufacturers who have established mounting locations for the starter and any access openings in the apparatus cabinet wall. Also, in repair situations, when an updated starter is used to replace an older starter, the reset plunger will likely not align with the access opening in the cabinetry. Therefore, to enable customers to take advantage of updated technology in recent design starters and to permit the manufacturer of the starter to phase out old design starters by providing newer technology devices that can be retrofit into the same mounting situation as the older device, the control button adaptor described herein has been provided.

SUMMARY OF THE INVENTION

This invention provides a control button adaptor for electric control apparatus wherein the location of a depressible lever or plunger of the control apparatus is offset from the desired location of a finger-engagable push-button intended to cooperate with the plunger. The adaptor is a unitary molded member configured to utilize structural features of the contactor for mounting the adaptor to the contactor without the use of tools or additional fastening means. A depending tongue is offset to overlie the depressible plunger of the control apparatus and has a finger-engagable pushbutton portion located substantially on the medial line of the control apparatus. The adaptor is disposed closely adjacent or lightly rests against the control plunger of the apparatus in an at-rest position of the adaptor so as not to introduce preloading forces or pressures on the control apparatus plunger. The adaptor also is provided with self-contained integral torsion spring portions which cause the adaptor member to return to the at-rest position when external forces are removed from the adaptor. The adaptor renders newly manufactured starters compatible with OEM previous requirements. The adaptor is particularly useful in repair situations wherein the repairman may replace a starter with a newer model, using the adaptor to effect alignment of the reset button with the access opening in the enclosure. Thus, the repair job may be completed in a single visit whereas without the adaptor it may have been necessary to order out an older model starter or modify the enclosure or cabinet. Further, the adaptor permits updated starter technology to be retrofit to existing OEM product applications with little or no revision to the product. These and other features and advantages of the invention will become more readily apparent when reading the following description and claims in conjunction with the accompanying drawings.

BRIEF DESCRIPTION OF THE DRAWINGS

FIG. 4 is a perspective view of the control button adaptor of this invention;

FIG. 5 is a side elevational view of the control button adaptor shown in FIG. 4, partly in section as indicated by the line 5—5 in FIG. 4; and FIG. 6 is a partial sectional view of the contactor housing and the control button adaptor of this invention taken along the line 6—6 in FIG. 1.

DETAILED DESCRIPTION OF THE PREFERRED EMBODIMENT

Figure 1:
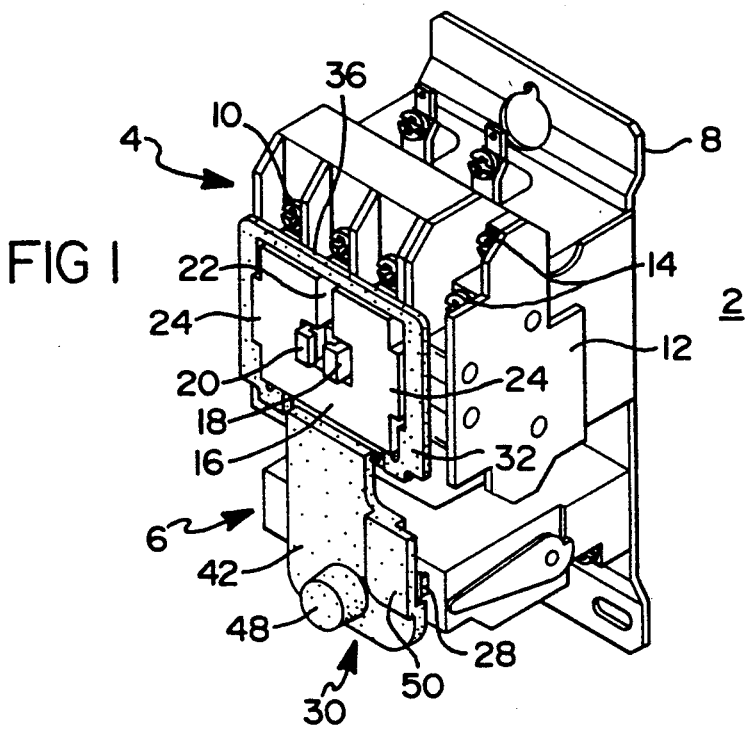
FIG. 1 is a perspective view of an electromagnetically operated electric motor starter having the control button adaptor of this invention attached thereto.
Figure 3:
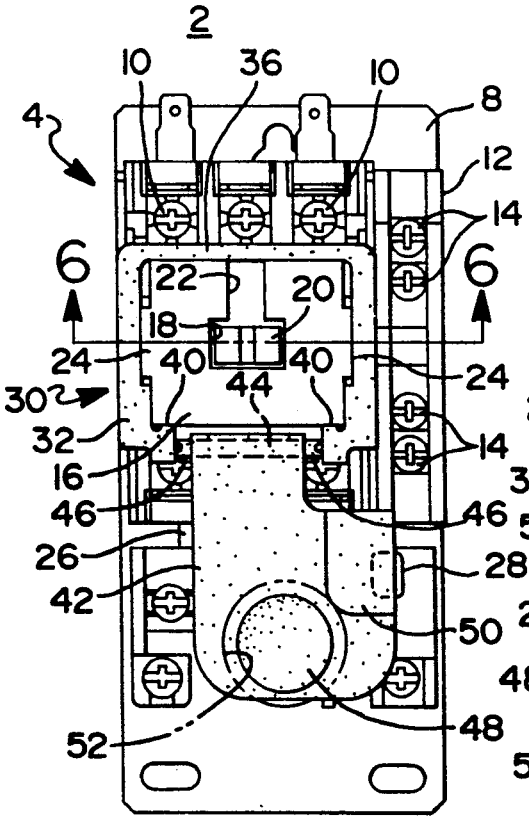
FIG. 3 is a front plan view of the starter of FIGS. 1 and 2 with an access opening for a finger-engagable pushbutton shown in dotted lines.
Figure 2:
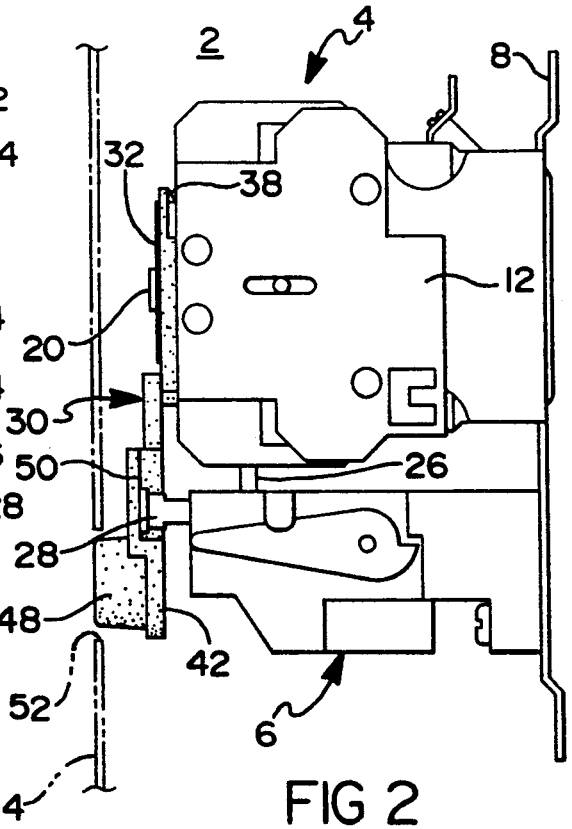
FIG. 2 is a side elevational view of the starter of FIG. 1 with a covering panel of an enclosure or a cabinet of associated apparatus shown in broken line.

An electromagnetically operated electric motor starter 2 is shown in FIGS. 1, 2 and 3 as comprising an electromagnetically operated contactor 4 and a thermally responsive overload switching relay 6 mounted adjacent each other on a common mounting plate 8. Electromagnetic contactor 4 is a definite purpose contactor of the type shown and described in U.S. Pat. No. 4,525,694 issued Jun. 25, 1985, to W. G. Dennison et. al., the disclosure of which is incorporated herein by reference. Contactor 4 is a three pole device having three sets of stationary contacts connected to respective terminals 10 bridged by respective movable contacts upon energization of an electromagnet operate coil within the contactor. Additional contacts connected to terminals 14 may be provided by an electrical interlock switch 12 mounted to the side of contactor 4 and operated in a well known manner by cooperable interengagement (not shown) of a movable contact carrier of the electrical interlock switch 12 with the armature for the electromagnet within contactor 4.

The forward surface of the housing of contactor 4 has a substantially rectangular protrusion 16 having a rectangular central opening 18 therein through which a projection 20 of the armature/movable contact carrier assembly of the contactor extends. Rectangular protrusion 16 of the housing of contactor 4 is provided with a slot 22 in the upper leg thereof extending into the rectangular aperture 18 to permit access through the slot 22 to a T-shaped slot in the projection 20 for accomplishing an operative connection between the armature/contact carrier of contactor 4 and the movable contact carrier of an auxiliary contact block (not shown) in a manner well known in the art. Rectangular protrusion 16 has a pair of lateral wings or projections 24 as seen in FIGS. 1, 3 and 6 which have their rear edges beveled. The aforementioned auxiliary or add-on contact block is provided with complemental mating projections which interlock behind the projections 24 to mechanically secure the add-on block to the housing of contactor 4 by sliding the add-on block downward over the protrusion 16. A movable contact carrier of the add-on block is provided with a complementally T-shaped end portion which is slid through the slot 22, during attachment, to be received in the inverted T-shaped recess within projection 20. The construction of the add-on auxiliary contact blocks and their interconnection to the housing and armature/contact carrier of the contactor 4 is well known in the electromagnetic contactor art and will not be dealt with in greater detail herein.

Overload relay 6 is of the type shown and described in U.S. Pat. No. 4,096,465 issued Jun. 20, 1978 to P. C. Fryer, the disclosure of which is incorporated herein by reference. Overload switching relay 6 is a three pole device providing for three phase supply to an electric motor. Although not specifically shown, the wiring terminal for each pole of the overload relay 6 is electrically connected through a connector such as 26 (FIGS. 2 and 3) to a corresponding terminal of a respective pole of the electromagnetic contactor 4. Each pole of the overload relay 6 is provided with a thermal heating element in the circuit leading to the contactor 4. Thermally responsive elements such as bimetal members are disposed in close proximity to the thermal heating elements in each pole of the overload relay to deflect in response to heat generated by the heating element. A mechanism common to all three poles is operated by the deflected bimetals to trip a switch within the overload relay adjacent one end thereof. That switch is connected in circuit with the operate coil of electromagnetic contactor 4 so as to open the circuit to the contactor coil when the switch is tripped open to thereby deenergize the contactor coil, causing the contactor to drop out and open its contacts, removing or disconnecting power from the motor. The switch mechanism of the overload relay is resettable by a plunger 28 which is linearly depressible into the housing of overload relay 6.

Referring particularly to FIG. 3, it can be seen that the reset button 28 of overload relay 6 is offset from the center of the starter 2, being located closer to a lateral edge of the starter than to the median thereof. Previously manufactured starters, having the same dimensional and space requirements for mounting as starter 2, had an overload relay element similar to that disclosed in U.S. Pat. No. 2,673,268 issued Mar. 23, 1954 to C. W. Kuhn et. al. That overload relay had its own finger-sized reset button incorporated therein as an actual element of the device. The reset button was located substantially on the center line of the starter. Therefore, to render the starter 2 shown in this application compatible with apparatus built to accommodate the earlier version of the starter, the control button adaptor of this invention is provided. The adaptor 30 is shown separately in perspective view in FIG. 4.

Adaptor 30 comprises a mounting platform portion in the form of a rectangular frame 32 having an open center. Lateral edges of frame 32 are provided with inwardly directed ledges 34, the upper surfaces of which are beveled complementally to the rear surfaces of projections 24 on protrusion 16 of contactor 4. Ledges 34 are formed in the plane of the bottom, or rear, surface of frame 32. The upper leg 36 of the frame 32 is stepped forwardly along the rear surface to provide access to the ends of ledges 34 for sliding engagement thereof over the protrusion 16 such that ledges 34 may engage behind the projections 24. Leg 36 is provided with a pair of latch cams 38 which deflect the leg 36 upwardly over the forward surface of protrusion 16 and the projection 20 of the contact carrier of the contactor to snap over the upper edge of protrusion 16, securing the adaptor 30 firmly to the housing of contactor 4 in the place where an add-on auxiliary contact block may have been attached. T thickness of frame portion 32 is preferably dimensionally controlled to effect a snug fit between ledges 34 and projections 24. However, an alternative embodiment provides a pair of narrow ramps 39 (only one shown in FIG. 5) formed on the rear surface of frame 32 at the positions of ledges 40 (to be described hereinafter). Ramps 39 rest against interphase barriers of the contactor housing to urge member 30 forwardly and therefore to urge the ledges 34 firmly into engagement with projections 24. The relatively small mass of the narrow ramps 39 permits the ramps to be compressed to thereby accommodate adverse dimensional tolerance conditions. As seen in FIG. 4, the lower leg of frame 32 is provided with ledges 40 at the opposite sides which abut the lower edge of protrusion 16 to vertically position the adaptor 30 to the protrusion 16 in conjunction with upper leg 36. A cantilever portion 42 depends from the lower leg of frame 32. Portion 42 is interconnected with the frame by a generally semicircular axle portion 44 which extends along the back surface of portion 42 and extends beyond lateral edges of portion 42 as semicircular webs 46 integrally connected with frame 32. A finger-engagable button portion 48 projects forwardly from the lower or distal end of cantilever section 42. Cantilever portion 42 is offset laterally to the right as viewed in the drawings and has a forwardly stepped portion 50 which overlies reset plunger 28.

Button adaptor 30 may thus be attached to the starter by sliding the window frame platform portion 32 upwardly over protrusion 16 to engage ledges 34 of member 30 with the backside of projections 24. When ledges 40 abut against the lower edge of protrusion 16, the upper leg 36 of frame 32 snaps over the upper edge of protrusion 16 to firmly lock the member 30 in place. Frame 32, or ramps 39 in the aforedescribed alternative embodiment, bears against the housing of contactor 4 to urge the adaptor 30 forwardly, thereby urging tight engagement between ledges 34 and projections 24. When member 30 is thus attached to contactor 4, cantilever portion 42 depends therefrom and is disposed in front of the overload relay 6. Stepped portion 50 overlies the forward end of reset plunger 28. The back surface of stepped portion 50 may be in light contact with plunger 28, or preferably is spaced slightly therefrom so as not to introduce preloading forces on the switch of the overload relay. Pushbutton portion 48 aligns with an opening 52 in a panel 54 of an enclosure or of the apparatus cabinet in which the starter 2 is used. The size of button portion 48 is such that it is readily engagable by a human finger for depression through the aperture 52. Depression of button portion 48 depresses the entire cantilever section 42, thereby also depressing plunger 28 to reset the switch mechanism of the overload relay 6. Depression of cantilever portion 42 as aforedescribed in reality amounts to deflection of that member about the axis provided by semicircular section 44 and semicircular web portions 46. Webs 46 twist during such deflection to provide a torsional return bias to the cantilever portion 42 whereby it returns to its normal at-rest position once the force provided by the human finger is removed.

The foregoing provides a button adaptor for an electric motor starter which locates a reset button for the starter at a position compatible with previously supplied, older design starters, enabling state of the art advancements and technology to be employed in OEM equipment without the need for modifying mounting locations or cabinet holes. The adaptor is also convenient for repairmen who may replace older, harder to obtain and perhaps discontinued starters with newer, state of the art starters without the necessity of revising the cabinetry or mounting arrangement of the apparatus. It will be appreciated that the shape of cantilever portion 42, offset portion 50 and the location of button portion 48 on cantilever portion 42 may vary according to the differences between the particular current model starter and the earlier model starter being replaced. Although the invention is shown in an preferred embodiment, it is to be understood that it is susceptible of various modifications without departing from the scope of the appended claims.

I claim:

1. A control button adaptor for electric control apparatus wherein location of a finger-engagable button portion is predetermined relative to location of a corresponding lunger of said apparatus to be depressed in response to depression of said button, said adaptor comprising:

a platform portion attached to said apparatus, said apparatus having a pair of oppositely directed projections cooperably engagable with a pair of oppositely inwardly directed ledges on said platform portion by sliding said platform portion onto said apparatus, said platform portion having resiliently deflectable means engaging said apparatus for blocking sliding movement of said adaptor in a direction to disengage said ledges and said projections;

a cantilever portion extending from said platform portion and overlying a depressible plunger of said apparatus, said cantilever portion being deflectable in a direction to effect depression of said plunger; and a finger-engagable button portion projecting from said cantilever portion at a predetermined location thereon offset in a significant plane of said cantilever relative to said depressible plunger.

2. The control button adaptor of claim 1 wherein said platform portion comprises ramp members bearing against a surface of said apparatus, urging said ledges firmly into engagement with said projections.

3. The control button adaptor of claim 1 wherein said platform portion comprises a frame defining an opening in which said ledges are disposed and said apparatus comprises a protrusion shaped generally complementally to said opening, said projections being located along lateral surfaces of said protrusion, a leading edge of said frame when said platform portion is slid into engagement with said apparatus being resiliently deflected along a top surface of said protrusion and snapping over an edge of said protrusion to block sliding movement of said adaptor in a direction to disengage said ledges and said projections.

4. The control button adaptor of claim 1 wherein said cantilever portion is disposed to overlie said depressible plunger without depressing said plunger in a normal position of said cantilever portion.

5. The control button adaptor of claim 1 wherein said cantilever portion is connected to said platform portion by integral webs extending along an axis of deflection of said cantilever portion relative to said platform portion, said webs providing a torsional bias to return said cantilever portion from a deflected position.

6. The control button adaptor of claim 3 wherein said cantilever portion is connected to said platform portion by integral webs extending along an axis of deflection of said cantilever portion relative to said platform portion, said webs providing a torsional bias to return said cantilever portion from a deflected position.

7. A reset button adaptor for an electric motor starter comprising an electromagnetically operated contactor and a thermally responsive overload relay mounted adjacent one another, contacts of said contactor connected in series with thermal means of said overload relay and in series with a power supply and a load for monitoring current supplied to said load, said overload relay comprising a switch connected in circuit with an operating coil of said contactor, a thermally responsive mechanism for operating said switch to an open condition in response to predetermined current conditions to said load, said open switch effecting deenergization of said operating coil and corresponding opening of said contactor contacts to disconnect said load from said supply, and a reset plunger disconnect said load from said supply, and a reset plunger depressible to re-close said switch, characterized by: said reset button adaptor comprising:

a platform portion attached to said electromagnetic contactor, said electromagnetic contactor having a pair of oppositely directed projections cooperably engageable with a pair of oppositely inwardly directed ledges on said platform portion by sliding said platform portion onto said contactor, said platform portion comprising resiliently deflectable means engaging said contactor for blocking sliding movement of said adaptor in a direction to effect disengagement of said ledges from said projections;

a cantilever portion extending from said platform portion and overlying said reset plunger, said cantilever portion being deflectable in a direction parallel to depression movement of said reset plunger; and a finger-engagable button portion projecting from said cantilever portion at a predetermined location thereon offset in a significant plane of said cantilever portion relative to said depressible plunger.

8. The reset button adaptor of claim 7 wherein said platform portion comprises ramp means bearing against a surface of said contactor, urging said ledges firmly into engagement with said projections.

9. The reset button adaptor of claim 7 wherein said platform portion comprises a frame defining an opening in which said ledges are disposed and said contactor comprises a protrusion complementally shaped to said opening, said projections being located along lateral surfaces of said protrusion, said frame resiliently deflecting over said protrusion and snapping over said protrusion to block sliding movement of said adaptor in a direction to disengage said ledges and said projections.

10. The reset button adaptor of claim 9 wherein said cantilever portion is connected to said platform portion by integral webs disposed on an axis of said deflection of said cantilever portion relative to said platform portion, said webs providing a torsional bias to return said cantilever portion from a deflected position.

11. The reset button adaptor of claim 10 wherein said cantilever portion is disposed to overlie said depressible plunger without depressing said plunger in a normal at-rest position of said cantilever portion.

12. The reset button adaptor of claim 11 wherein said button portion is located intermediate lateral edges of said starter and said reset plunger is located proximate a lateral edge of said starter.

* * * * *